US005613760A

United States Patent [19]

Dunn

[11] Patent Number: 5,613,760

[45] Date of Patent: Mar. 25, 1997

[54] CANDLE LANTERN

[76] Inventor: Rosemary M. Dunn, P.O. Box 3645, Myrtle Beach, S.C. 29578

[21] Appl. No.: 561,866

[22] Filed: Nov. 22, 1995

[51] Int. Cl.[6] ..... F21L 19/00

[52] U.S. Cl. ..... 362/161; 362/182; 362/315; 362/806

[58] Field of Search ..... 362/374, 159, 362/161, 182, 313, 315, 285, 806, 399, 812

[56] References Cited

U.S. PATENT DOCUMENTS 360,814 4/1887 Muller ..... 362/161 X 1,091,248 3/1914 Sarkadi ..... 362/161

5,264,995 11/1993 McKee ..... 362/161

*Primary Examiner*—Stephen F. Husar

*Attorney, Agent, or Firm*—Robert Halper

[57] ABSTRACT

A functional, commemorative, handcrafted candle lit lantern made in many colors and enlosed in glass panels, the front panel being elevatable, a dripless candle seated on a pedestal, wherein the candle can be raised through a roof of the lantern to be snuffed out or lit, a brass plate on the front side of the base of the lantern having an inscription descriptive of the lantern thereon, the front panel having an etching depicting a pictorial scene that corresponds with the inscription and a laminated card having an anecdote commensurate with the inscription associated therewith.

8 Claims, 1 Drawing Sheet

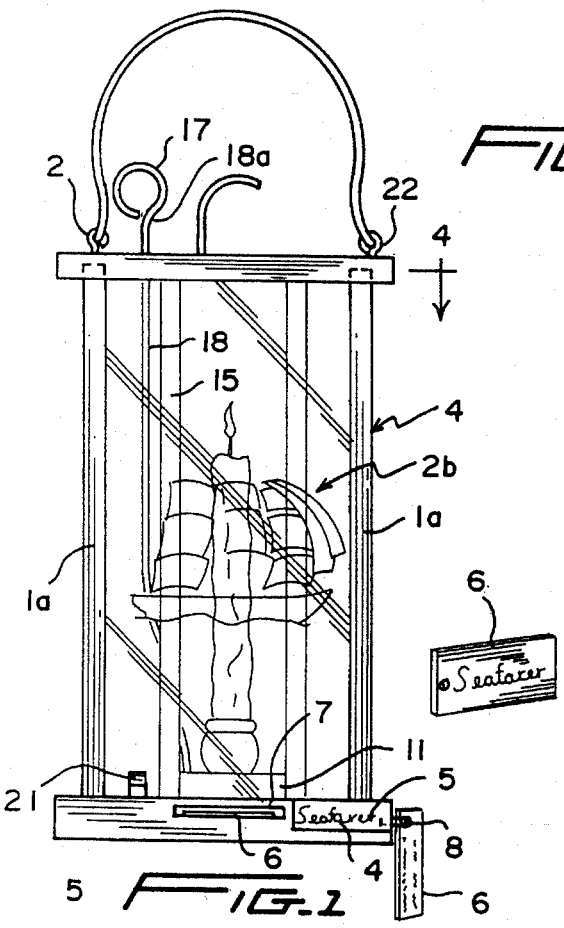
FIG. 1
FIG. 2
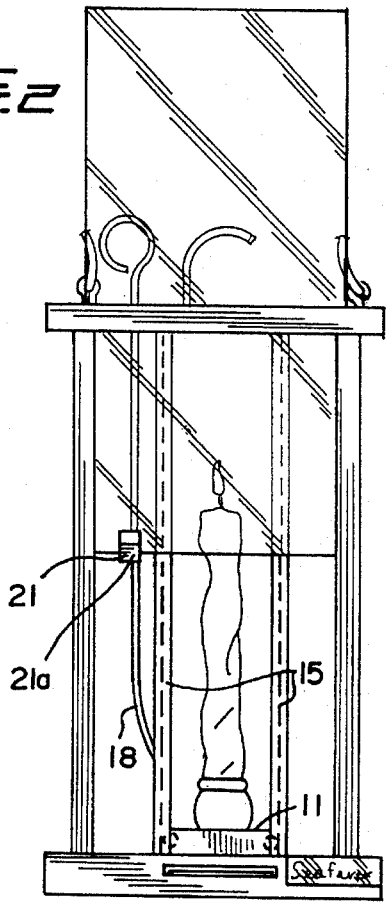
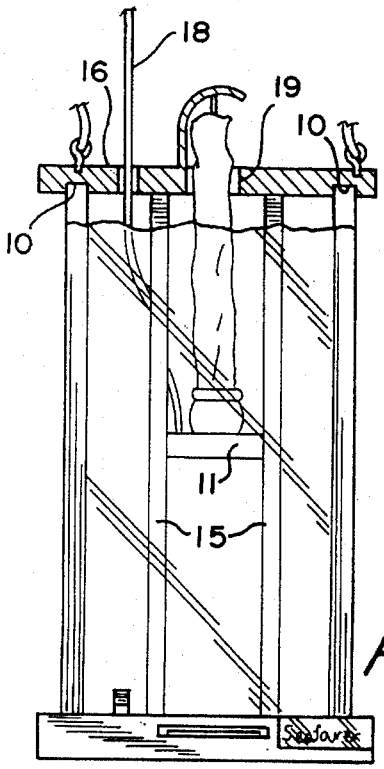
FIG. 3
FIG. 4
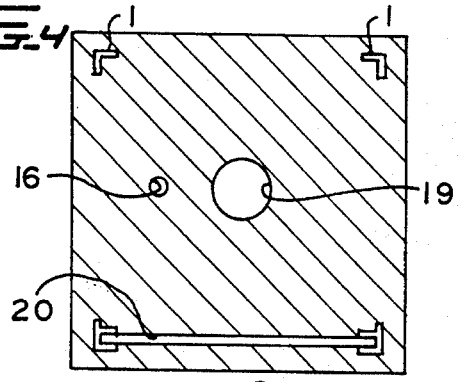
FIG. 5
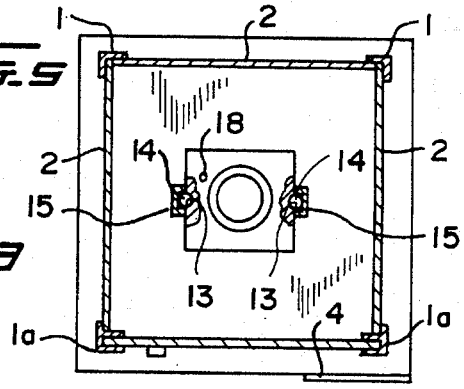

CANDLE LANTERN

FIELD OF INVENTION

This invention is concerned with candle tit lanterns that cn be specially handrafted and are functional and commemorative.

BACKGROUND OF THE INVENTION

U.S. Pat. No. 46,184 is an example of a candle lantern wherein the lantern has a case with a glass front protected by a cover when not in use. At the bottom of the case is a cylindrical flange encircling an opening. A tube screws into the flange and a spiral spring is inserted into the tube to bear against the lower end of the candle and always keep the handle pressed against the upper flange. The tube slides freely in the cylindrical flange so that it may be moved entirely into the case or drawn out as desired. When in use the tube is drawn partially out of the case so that the tube may be used as a handle to carry the handle. There are hooks on the side for suspending the handle from a support.

U.S. Pat. No. 150,572 shows a decorative lantern that may be hung from a chain. It is trapezoidal in shape with pasteboard sidepieces fitted with transparent panels. A closed bottom supports a socket for a candle. A wire frame is placed around the upper interior to support the paste board pieces.

U.S. Pat. No. 1,082,896 teaches a lantern that has upper and lower straps for securing the lantern to a person. The lantern is of arcuate shape having a transparent door which is hingedly mounted to swing open. Opposite the hinge is a latch for locking the door. A candle holder comprises a plate secured within the lantern to the bottom and having grooves for receiving laterally extending flanges of a candlestick. The back of the lantern is fitted with flanges and adapted to be seated in a socket of the support, which is a rectangular elongated hollow member having front, rear and side walls, these walls being disposed against the lamp and towards the person. The side walls are formed with perforations which permit circulation of air between the lantern and the body of a person. Walls at the top of the lantern have holes to allow escape of smoke while holes at the bottom allow proper combustion.

U.S. Pat. No. 2,517,197 shows a collapsible safety lantern supported on a partitioned base for storing the lantern body and candle when not in use. There are tow pairs of hinged door members that enclose colored glass panels. The lantern has a central opening for supporting a candle on a removable support. When the lantern is to be dismantled pins are removed from door posts. A spring handle is provided and mounted in holes in flanges that support a top cover. The handle can be readily sprung from the holes.

U.S. Pat. No. 3,327,108 teaches a hurricane lantern which has a globe that fits into a lantern frame assembly that includes a collar having a flat upper portion and a skirt. Set screws secure the collar to the globe. An inverted U shaped handle is secured to the collar for transport. The lantern has a fuel holder assembly with a bowl for supporting a candle. Hanger strips extend upwardly from the bowl and are connected to a disc type hood. The hanger strips have attached thereto a member supporting angle pieces that engage the flat portion of the collar for suspending the bowl in the globe. The hood is located above the collar. When the candle is in the globe, it is windproof. If the candle is to be lit or snuffed out, the fuel holder assembly can be raised out of the bowl.

U.S. Pat. No. 4,787,017 teaches a memorial light for symbolizing the memory of a deceased. When not in use, the lantern is stored in a base box located in the grave covering material in the region of the headstone. On the lid of this box is a formed piece on which the lantern can be slidably attached. The lantern has mating pieces for supporting glass panels. A slanted roof has shaped pieces at the bottom that slide into extending planar members that are attached to four vertical supports. At the base of the lamp are air ventilating holes Instead of glass panels heat resistant plastic can be used.

U.S. Des. Pat. No. 246,135 shows a candle lantern design having a handle chain. The candle with holder is enclosed in a transparent casing.

U.S. Des. Pat. No. 321,761 shows a lantern with handle connected to a chain. The candle holder is spring mounted so it can be elevated into a cylindrical hood.

While the lanterns described above are useful, they serve a limited purpose such as being ornamental, as old army camp lanterns, hurricane lanterns, safety lanterns on trucks, lanterns adapted to be worn on a person, or memorializing the deceased at a gravesite. Furthermore such lanterns always left a waxy resideu which was difficult to clean.

It is therefore an object of this invention that has ornamental appeal and can be adapted to a plurality of functions.

It is still an object of this invention o produce a lantern that can be used as a commemorative device.

It is a further object of this invention to use a candle in the lantern that does not produce a waxy residue.

It is an additional object of this invention that can be handcrafted to suit.

SUMMARY OF THE INVENTION

The lantern of this invention is generally of rectangular shape having a base and a roof between which are four angled posts in which are mounted four glass panels, the front one being mobile. The roof fits over the posts and has a centered opening that serves as a chimney and also allows for removal of a candle located in an urn shaped holder fixed to a movable pedestal adjacent the base. Attached to the pedestal is a rigid wire that devolves to a ring that enables lifting the pedestal and elevating the candle through the opening. An offshoot of the wire below the ring extends to form an arc whereby the candle when elevated can be snuffed out. The mobile glass plate has a detachable hook to lift up the plate through a slit in the roof so that the candle can be removed and the lantern cleaned. On the top of the roof is attached a handle made of cord. The base of the lantern has a brass plate on which various indicia can be inscribed suit. For example, the lantern can be named "Mountain Man", "Seafarer", "Oriental Lantern", and personalized with an initial. The lantern can also be painted in various colors that correspond to the name and attached to the plate there will be a laminated card with an anecdote commensurate with the title on the plate. The front glass panel can also have various designs etched on it.

BRIEF DESCRIPTION OF THE DRAWINGS

FIG. 1 is a frontal view of the lantern.

FIG. 2 is a partial frontal view showing the front glass panel in elevated position.

FIG. 3 is a partial frontal view showing the candle being lifted.

FIG. 4 is a sectional plan view on line 4—4 showing the roof construction.

FIG. 5 is a sectional plan view showing the posts and arrangement of the glass panels.

DETAILED DESCRIPTION OF THE DRAWING

FIG. 1 shows a lantern L of rectangular shape having a metal framework made of 4 angular posts 1, 1*a*. The two angles 1 in the rear wall will be true angles, whereas angles 1*a* in the front will have their transverse legs separate from each other. That is, instead of each transverse leg being a single unit, the leg will be hollowed out leaving two separate segments. However these segments are joined at the junction of the transverse leg with the other leg of the angle. Glass panels 2 at the rear and sides will be fixed to the legs of the angular posts on the inner sides with a high temperature adhesive. The front glass panel will slide into the open end of angular post 1*a* and will be mobile. The posts are soldered to a metal base 3 that extends somewhat beyond the posts. A brass plate 4 is adhesively bound to the front of the base and an inscription 5 to suit the propspective buyer can be placed thereon identifying the type of lantern. For example, "Seafarer" representative of sailors and fishermen or a golfing lantern, an oriental lantern, etc. and initialized. The lantern frame is colored in a manner that best represents the nane on the brass plate A scene 2*b* representative of the name can be etched on the outer side of the front glass panel. For example, if a golfing lantern, an etching such as two tees and a golfball can be made. The etching can also be personalized with the customer's initial or name. In performing this operation, the glass is first acid etched and then sand blasted to make the design. Accompanying the inscription on the brass plate would be a laminated card 6 having an anecdote commensurate with the inscription. The card could fit into a slot 7 cut out in the base, or it could hang from a stud 8 threaded into the base. Roof 9 encloses the posts and is of the same dimension as the base. On the underside of the roof are four angular grooves 10 that would press snugly over the angular posts. Resting on the base and located in the center of the glass enclosure is a rectangular pedestal 11. Soldered to the pedestal is an urn shaped candle holder 12 provided with a cylindrical interior to contain a dripless candle 12*a*. At the center of each side of the pedestal a small circular opening 13 is bored for the insertion of a ball bearing 14. Adjacent the ball bearing are two rails 15 soldered to the roof and base. These rails serve as guides for the bearing when the pedestal is elevated. A rigid wire 15 is soldered to the pedestal and extends upwardly through a perforation 16 in the roof. The wire above the roof devolves into a ring 17, and near the ring another wire 18, soldered to the roof, is shaped to form an arc 18*a*. The arc is positioned over a circular opening 19 aligned with the candle but somewhat larger. When it is desired to snuff out or light the candle, ring 17 is grasped and pulled upwardly to elevate the pedestal with candle holder and candle along the guide rails above the roof till the candle contacts the arc and is snuffed out or the candle is elevated to light the same. The opening also serves as a chimney to aid combustion and remove gases and vapors. The roof also has a slit 20 aligned with the front glass panel. A detachable J shaped clip 21 snaps on to the bottom near to the left side of the glass panel. At the end of the J is a downwardly inclined hook 21*a* for elevating the glass panel. When the lantern needs cleaning or the candle has to be replaced, the glass panel is lifted out through the silt in the roof to enable the aforesaid functions. Except for the glass panels the framework and accessories are made of a metal such as brass, in which case a separate brass plate need not be made. On the other hand, instead of metal the lantern could be made of pine which has been fireproofed. The lantern can be made portable by using a cord made of nylon or similar synthetic material attached to the roof by placing two threaded hooks 22 on each centrally located side of the roof and looping the cord over the hooks. Each lantern can be handcrafted to suit the taste of the customer, although many of the lanterns are produced with various inscriptions, materials and colors so that this may not be necessary.

It will be obvious to the skilled artisan that the presently described lantern is susceptible to various modifications within the scope of the appended claims.

I claim:

1. A functional, commerative lantern having a candle lighting system that comprises:

a) a lantern frame having four spaced angular posts mounted between a base and a roof, two of said angular posts being mounted in the rear and two of said posts mounted in the front, said angular posts having legs perpendicular to each other, each leg having an inner and outer side, said front angular posts having transverse legs that are spaced from each other and unconnected, b) four glass panels fitted to said posts and extending somewhat less than than the length of said posts, said panels including side panels a rear panel and a front panel, said side and rear panels being adhesively connected to said inner side of said legs, said front panel sliding into said unconnected transverse legs of said angular posts;

c) said base having a front side and a brass plate adhesively bonded thereto, said brass plate having an inscription thereon defining the name of the lantern, and a laminated card containing an anecdote commensurate with said inscription associated with said plate;

d) a rectangular pedestal resting on said base having a candle holder with dripless candle therein extending upwardly from said base and an opening in said roof aligned with said candle, said opening being large enough to accommodate a candle that passes therethrough, said opening serving as a chimney to aid in combustion and allow gases to exit therethrough;

e) said pedestal having sides, a circular opening in the center of said sides and a ball bearing placed therein, a rigid wire attached to said pedestal and extending upwardly through a perforation, in said roof and devolving into a ring, another wire soldered to said roof that extends to form an arc located over said opening in said roof.

f) a pair of guide rails in alignment with said ball bearings and connected between said roof and said base, said ball bearings in cooperation with said rails allowing said pedestal to be uniformly elevated when said ring is pulled upwardly so that candle will emerge through said opening until it contacts the arc and is snuffed out or will emerge through the hole to be lit.

2. A lantern as in claim 1 wherein said front panel has an etching on its outer side depicting a pictorial scene in accordance with the name of said lantern.

3. A lantern as in claim 1 wherein said posts, base, pedestal, candle holder, roof and wire are made of metal and said candle holder and wire are soldered to said pedestal.

4. A lantern as in claim 3 wherein said metal is brass.

5. A lantern as in claim 1 wherein said posts, base, and roof are made of pine and said candle holder and wire are adhesively attached.

6. A lantern as in claim 1 wherein said roof has a slit aligned with said front glass panel and a detachable J shaped clip having a hook on the end of said J associated with said glass panel for enabling sliding of said glass panel through said slit to permit candle replacement and cleaning of said lantern.

7. A lantern as in claim 1 wherein said lantern is colored, hand crafted, has a rectangular shape and has slot in said front side of said base for storage of said laminated card, said lantern having a loose fitting handle attached to the roof.

8. A lantern as in claim 7 wherein said handle is made of nylon cord and said roof has two spaced hooked, threaded studs therein, said cord being looped around said studs.

* * * * *